US010662855B2

(12) United States Patent
Lank et al.

(10) Patent No.: US 10,662,855 B2
(45) Date of Patent: May 26, 2020

(54) HANDHELD WORK APPARATUS

(71) Applicant: Andreas Stihl AG & Co. KG, Waiblingen (DE)

(72) Inventors: Jonas Lank, Winnenden (DE); Benjamin Friedrich, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 9 days.

(21) Appl. No.: 16/198,640

(22) Filed: Nov. 21, 2018

(65) Prior Publication Data

US 2019/0153926 A1 May 23, 2019

(30) Foreign Application Priority Data

Nov. 23, 2017 (EP) ..... 17203403

(51) Int. Cl.

| | |
|---|---|
| ***F01P 1/02*** | (2006.01) |
| ***F01P 1/06*** | (2006.01) |
| ***B25F 5/00*** | (2006.01) |
| ***F02B 63/02*** | (2006.01) |
| *B27B 17/08* | (2006.01) |

(Continued)

(52) U.S. Cl.

CPC ..... *F01P 1/02* (2013.01); *B25F 5/008* (2013.01); *F01P 1/06* (2013.01); *F02B 63/02* (2013.01); *B25F 5/006* (2013.01); *B27B 17/02* (2013.01); *B27B 17/08* (2013.01); *F01P 1/10* (2013.01); *F01P 2060/16* (2013.01); *F02B 2075/025* (2013.01)

(58) Field of Classification Search

CPC ..... F01P 1/02; F01P 1/06; F01P 2001/023; F01P 2001/026; B27B 17/02; B25F 5/008; F02B 63/02

See application file for complete search history.

(56) References Cited

U.S. PATENT DOCUMENTS

| | | | | |
|---|---|---|---|---|
| 4,846,301 A | | 7/1989 | Granath et al. | |
| 5,269,265 A | * | 12/1993 | Pretzsch | F01P 5/06 123/198 E |

(Continued)

FOREIGN PATENT DOCUMENTS

| | | |
|---|---|---|
| WO | 2013042535 A1 | 3/2013 |
| WO | 2014126017 A1 | 8/2014 |
| WO | 2014163078 A1 | 10/2014 |

*Primary Examiner* — Jacob M Amick

(74) *Attorney, Agent, or Firm* — Walter Ottesen, P.A.

(57) ABSTRACT

A handheld work apparatus has a fan wheel and a combustion engine having a cylinder and a crankcase. The fan wheel, arranged in a housing, is driven by the engine in a rotational direction. The housing includes a rear wall and a peripheral delimiter having a first and a second end delimiting an outlet for cooling air for the cylinder. The outlet extends from the second to the first end in the rotational direction. A throughflow-opening is provided in the housing, through which the cooling air flows out to the outside of the crankcase. The angular distance, measured proceeding from the first end in the rotational direction, between the first end and the throughflow-opening is smaller than the angular distance, measured proceeding from the throughflow-opening in the rotational direction, between the throughflow-opening and the second end. The angular distances are each measured about the rotational axis as a peripheral angle.

17 Claims, 10 Drawing Sheets

(51) Int. Cl.

| | |
|---|---|
| *B27B 17/02* | (2006.01) |
| *F02B 75/02* | (2006.01) |
| *F01P 1/10* | (2006.01) |

(56) References Cited

U.S. PATENT DOCUMENTS

| | | | | |
|---|---|---|---|---|
| 6,314,922 | B1 * | 11/2001 | Zimmermann | B25F 5/008 123/41.56 |
| 2011/0100308 | A1 * | 5/2011 | Kienzle | F01P 1/02 123/41.65 |
| 2012/0285410 | A1 * | 11/2012 | Stark | F02M 35/024 123/184.21 |
| 2014/0000537 | A1 | 1/2014 | Rieber et al. | |

* cited by examiner

Fig. 6
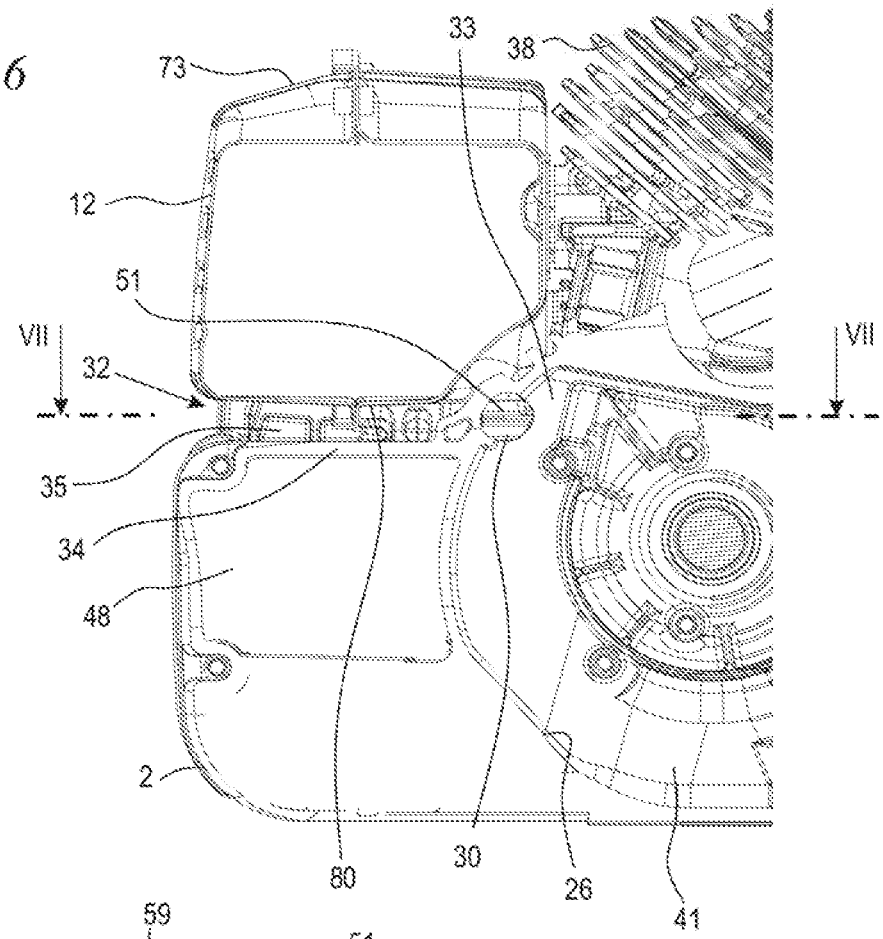
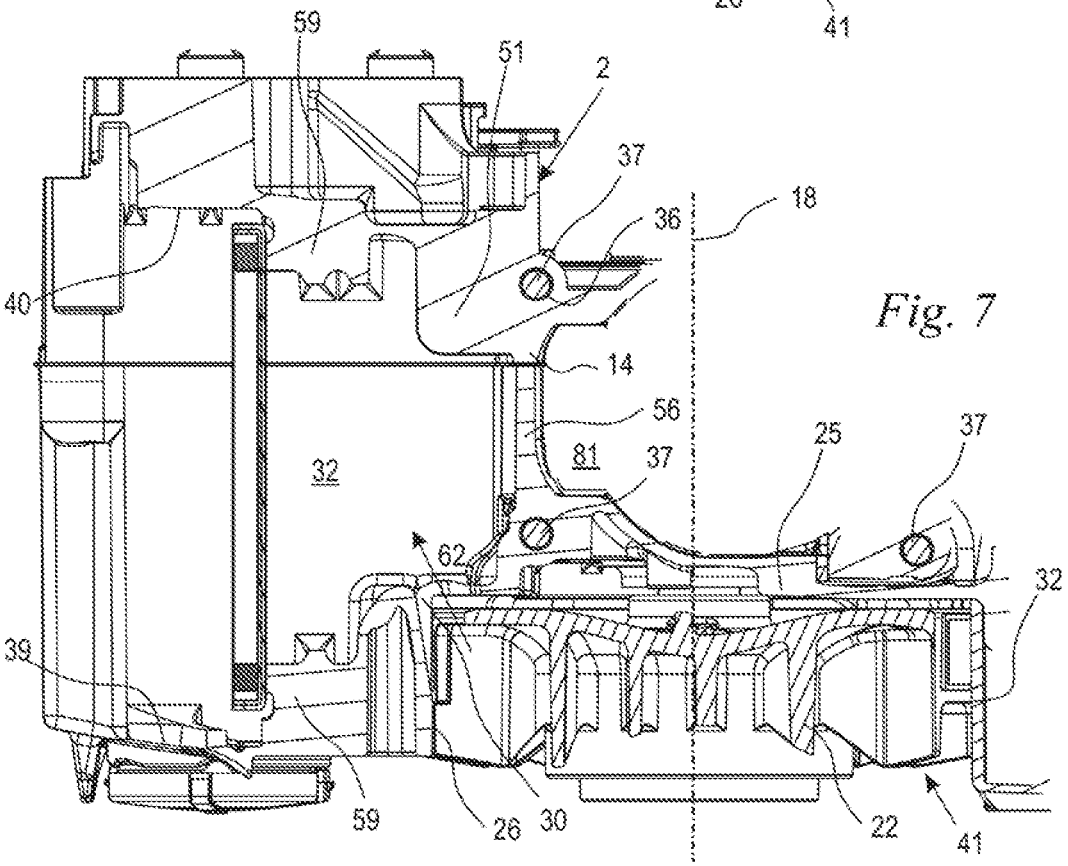
Fig. 7

HANDHELD WORK APPARATUS

CROSS REFERENCE TO RELATED APPLICATION

This application claims priority of European patent application no. 17 203 403.5, filed Nov. 23, 2017, the entire content of which is incorporated herein by reference.

BACKGROUND OF THE INVENTION

US 2014/0000537 discloses a handheld work apparatus with a combustion engine and a fan wheel for conveying cooling air for the combustion engine. The fan wheel is arranged in a fan wheel housing. The combustion engine has an injection valve for supplying fuel. The injection valve is arranged in a cooling region into which cooling air conveyed by the fan wheel flows via a connection opening in the rear wall of the fan wheel housing.

Fan wheel housings are usually realized in an approximately helical manner, the distance between the peripheral wall of the fan wheel housing and the rotational axis of the fan wheel increasing in the rotational direction of the fan wheel. An outlet, through which the cooling air flows from the fan wheel to the cylinder of the combustion engine, is usually provided at the end of the fan spiral. Conducting the cooling air, which has cooled the cylinder beforehand, subsequently to the muffler is known for cooling a muffler of the combustion engine. Such cooling air-guidance proceeds, for example, from U.S. Pat. No. 4,846,301.

SUMMARY OF THE INVENTION

It is an object of the invention to provide a handheld work apparatus which has an advantageous configuration and ensures good cooling.

The object can, for example, be achieved by a handheld work apparatus having: a combustion engine having a cylinder and a crankcase; a fan wheel defining a rotational axis and configured to convey cooling air for the combustion engine; a fan wheel housing; the fan wheel being arranged in the fan wheel housing and configured to be driven rotatingly in a rotational direction by the combustion engine; the fan wheel housing including a peripheral delimiter and a rear wall which faces the crankcase of the combustion engine; the peripheral delimiter having a first end and a second end; the first end and the second end delimiting an outlet for cooling air to be conveyed to the cylinder; the outlet extending from the second end to the first end in the rotational direction; the fan wheel housing defining a throughflow-opening through which the cooling air flows out of the fan wheel housing to the outside of the crankcase; wherein an angular distance ($\alpha$), measured proceeding from the first end in the rotational direction, between the first end and the throughflow-opening is smaller than an angular distance (ß), measured proceeding from the throughflow-opening in the rotational direction, between the throughflow-opening and the second end; and, wherein the angular distance ($\alpha$) and the angular distance (ß) are each measured about the rotational axis as a peripheral angle.

It is provided to arrange a throughflow-opening in the rear wall of the fan wheel housing which faces the crankcase. The peripheral wall of the fan wheel housing has a first end and a second end. The two ends delimit an outlet for cooling air for the cylinder. The outlet extends, in this case, from the second end to the first end in the rotational direction of the fan wheel. The throughflow-opening is arranged such that the angular distance, measured proceeding from the first end in the rotational direction, between the first end and the throughflow-opening is smaller than the angular distance, measured proceeding from the throughflow-opening in the rotational direction, between the throughflow-opening and the second end. The angular distance, in this case, is measured in each case about the rotational axis as a peripheral angle. The angular distance is measured in each case as a distance between a side of the peripheral delimiter and a side of the throughflow-opening. The distance is accordingly not measured to the center of the throughflow-opening. The throughflow-opening, in this case, is an opening that is realized separately from the outlet and consequently provides an opening that is present in addition to the outlet. A cooling air stream flows to the outside of the crankcase through the throughflow-opening and a separate cooling air stream flows to the cylinder of the combustion engine through the outlet. In other words, the cooling air which flows through the throughflow-opening to the outside of the crankcase is not preheated by the exhaust heat of the cylinder as it does not flow over the cylinder beforehand. This improves the cooling of the combustion engine.

The outlet extends in the rotational direction of the fan wheel in the rotational direction between the second end and the first end of the peripheral delimiter. The air for cooling the cylinder emerges from the outlet. The fan wheel conveys cooling air both to the throughflow-opening and to the outlet. The fan wheel is advantageously bladed on one side. However, providing the fan wheel with fan blades on both sides can also be provided. The cooling air is advantageously drawn-in from the ambient air via air vents. The fan wheel housing designates in particular the space in which the fan wheel of the combustion engine is situated.

The throughflow-opening lies closer to the first end of the peripheral delimiter in the peripheral direction, that is, at the start of the peripheral delimiter in the rotational direction, than to the second end of the peripheral delimiter, that is, at the end of the peripheral delimiter. The throughflow-opening is situated accordingly after the first end and prior to the second end of the peripheral delimiter in the peripheral direction with reference to the rotational direction of the fan wheel. As a result of the arrangement of the additional throughflow-opening closer to the first end of the peripheral delimiter, the total air volume conveyed by the fan wheel is increased. In the case of an arrangement of the throughflow-opening closer to the second end of the peripheral delimiter, it has been shown that the air from the cooling air stream is forked off and as a result the air volume conveyed to the cylinder is correspondingly reduced. Additional cooling air can be provided by the arrangement of the throughflow-opening without the cooling air conveyed through the outlet to the cylinder being markedly reduced. This improves, for example, the cooling of the entire combustion engine, namely the cylinder cooling and the cooling of the muffler space as well as of the crankcase and of the space in which the crankcase is arranged.

In an advantageous manner, the angular distance, measured proceeding from the first end in the rotational direction, between the first end and the throughflow-opening is less than 120°, in particular less than 90° and in a preferred manner less than 60°. As a result of the distance between the first end of the peripheral delimiter and the throughflow-opening being chosen to be comparatively small, the influence of the air volume conveyed through the throughflow-opening on the air volume conveyed through the outlet to the cylinder is negligibly small. An advantageous arrangement of the additional throughflow-opening on the side of the crank house on which, in a preferred manner, a muffler of the combustion engine is also arranged, is additionally produced as a result of the arrangement.

In an advantageous manner, the throughflow-opening extends at least in part into the rear wall of the fan wheel housing. As a result of the arrangement in the rear wall of the fan wheel housing, the directional vector, which specifies the main direction of flow of the air flowing through the throughflow-opening, has a directional component in the direction of the rotational axis of the fan wheel and is aligned, in particular, parallel to the rotational axis of the fan wheel.

In a preferred manner, the throughflow-opening extends at least in part into the peripheral delimiter of the fan wheel housing. As a result, it can be achieved that the directional vector, which specifies the main direction of flow of the cooling air emerging through the throughflow-opening, includes at least one directional component in the radial direction to the rotational axis of the fan wheel. In particular, the directional vector is aligned perpendicularly to the rotational axis of the fan wheel.

An arrangement of the throughflow-opening where the throughflow-opening extends in part into the rear wall and in part into the peripheral delimiter of the fan wheel housing is particularly preferred. By configuring the parts of the throughflow-opening in the rear wall and in the peripheral delimiter in a suitable manner, the cooling air stream can be steered in a simple manner in the desired direction.

It can be provided that at least one additional guide element for guiding the cooling air stream to the cylinder connects to the peripheral delimiter of the fan wheel housing. The additional guide element projects in particular approximately in the direction of the first end or in the direction of the rotational axis of the crank shaft. The additional guide element reduces the free flow cross section of the outlet in an advantageous manner.

An elevation which projects into the fan wheel housing is arranged in an advantageous manner on the rearward side of the throughflow-opening in the rotational direction of the fan wheel. The elevation reduces the flow cross section on the rearward side of the throughflow-opening in the rotational direction of the fan wheel. As a result, the elevation directs cooling air in the manner of a flow directing element from the interior space of the fan wheel housing through the throughflow-opening. The air volume flowing through the throughflow-opening is increased by the elevation. The forward contour of the elevation in the rotational direction advantageously corresponds to the peripheral embodiment of the throughflow-opening. The contour of the elevation accordingly corresponds to a lengthening of the peripheral wall of the throughflow-opening. The forward contour of the elevation in the rotational direction merges advantageously seamlessly into the throughflow-opening. In a particularly advantageous configuration, the forward contour of the elevation in the direction of flow is realized in a curved manner, in particular in an approximately blade-shaped manner.

In an advantageous configuration, the combustion engine includes a muffler, wherein the muffler is arranged in a muffler space. The muffler space, in this case, does not have to be a closed space inside a housing of the work apparatus but designates the region in which the muffler is arranged. In an advantageous manner, the muffler space is open to the surrounding area in part. In a preferred manner, the throughflow-opening connects the interior space of the fan wheel housing to the muffler space. Direct cooling of the muffler can consequently be achieved via the throughflow-opening. The cooling air, with which the muffler is cooled, is accordingly not utilized initially for cooling the cylinder and is only directed later to the exhaust gas muffler. The muffler is supplied with cooling air directly through the throughflow-opening which connects the interior space of the fan wheel housing to the muffler space. As a result, the cooling air which is directed to the muffler has not yet been preheated by the cylinder so that particularly effective cooling of the muffler is produced. In an advantageous manner, the muffler is fixed to a delimiter of the muffler space via at least one muffler screw. The at least one muffler screw is subject to a high thermal load as a result of the high heat input. The at least one muffler screw can be cooled in a targeted manner via the air flowing in through the throughflow-opening. This reduces the loss of preload force and thus prevents the muffler screw from coming loose. In a particularly advantageous configuration, the air flowing through the throughflow-opening is directed in a targeted manner to the at least one muffler screw by a suitable arrangement of the throughflow-opening and/or by at least one cooling rib.

In a particularly advantageous configuration, a section of the rear wall of the fan wheel housing delimits the interior space of the fan wheel housing with one side and the muffler space with the opposite side. The throughflow-opening is advantageously arranged in the section of the rear wall. The throughflow-opening is advantageously arranged in the section of the rear wall. As a result, the throughflow-opening connects the interior space of the fan wheel housing directly to the muffler space so that cooling air is able to pass directly from the fan wheel housing into the muffler space and cool the muffler. An intermediate space, into which the cooling air from the throughflow-opening flows, is formed expediently between the muffler and a wall of an engine housing of the work apparatus. In a particularly preferred configuration, the intermediate space is formed between an operating materials tank, in particular an oil tank, and the muffler. In a preferred manner, the wall of the engine housing is a wall of the operating materials tank. The intermediate space extends in an advantageous configuration on the bottom side of the exhaust gas muffler. The bottom side of the muffler, in this case, is the side which is arranged on the bottom with the work apparatus in a usual rest position.

In order to obtain an improved cooling effect, it is advantageously provided that at least one cooling rib projects into the muffler space. In a particularly preferred configuration, at least one cooling rib is configured such that it brings about a reinforcement of the engine housing at the same time and thus increases the stability of the engine housing.

It has been shown that in particular in the region of the screw connection of the cylinder on the crankcase, high temperatures can be generated in operation as the region is frequently not cooled sufficiently by the cooling air flowing around the cylinder. In an advantageous configuration, the cylinder is fixed on the crankcase via at least one cylinder foot screw. The cylinder foot screw, in this case, projects advantageously into a bore in the crankcase. The air flowing through the throughflow-opening advantageously flows against a wall section of the crankcase which adjoins the bore. As a result, improved cooling of the cylinder foot screw is achieved. In order to achieve further improvement in the cooling of the cylinder foot screw, it is advantageously provided that the at least one cooling rib is arranged on the outside of the wall section of the crankcase adjoining the bore. As a result, particularly good cooling in the region of the at least one cylinder foot screw is achieved. A further improvement in the cooling of the cylinder foot screw is achieved when a muffler sheet metal, which separates the muffler space to a great extent from the cylinder, is arranged between the cylinder and the muffler. In an advantageous manner, the muffler sheet metal projects almost to the wall of the muffler space and seals the muffler space to a large extent in relation to the cylinder in the region of the cylinder foot screws. An excess of air which has been preheated by the cylinder into the muffler space is largely able to be avoided as a result.

In an advantageous realization variant at least one cooling rib is arranged parallel to the wall of the engine housing which delimits the intermediate space. In a preferred configuration, with the work apparatus in the rest position, the at least one cooling rib extends almost horizontally. As an alternative to this, it can also be provided that at least one cooling rib is arranged perpendicularly to the wall of the engine housing delimiting the intermediate space. As an alternative to this, a combination of horizontal and perpendicular ribs can also be provided. The use of a cross rib, that is, multiple ribs which intersect one another, can also be provided advantageously for cooling.

In order to achieve favourable cooling air-guidance, it is advantageously provided that at least one cooling rib is arranged on the wall of the engine housing delimiting the intermediate space. In a particularly preferred realization, the at least one cooling rib is arranged, in this case, in an inclined manner, in particular at an angle of between 10° and 80°, in a preferred manner at an angle of between 20° and 70°, on the wall of the engine housing.

The muffler space advantageously includes a first transverse side, which lies adjacent to the fan wheel housing, and a second transverse side which is arranged opposite the first transverse side. It is advantageously provided that the at least one cooling rib extends up to the first transverse side. As a result, reinforcement of the engine housing is achieved by the cooling ribs at the same time. In a particularly preferred configuration, the at least one cooling rib is integrally molded on the first transverse side. As a result, good heat dissipation into the transverse side of the muffler space and in particular also into the engine housing is achieved. The first and the second transverse sides of the muffler space are advantageously integrally molded on the engine housing.

At least one cooling rib is advantageously arranged on the second transverse side of the muffler space. The at least one cooling rib on the second transverse side of the muffler space serves advantageously both for improved cooling and for guiding the cooling air emerging from the throughflow-opening. It can also be provided that at least one cooling rib extends from the first to the second transverse side of the muffler space.

The distance between the peripheral delimiter and the rotational axis is advantageously smaller on the first end than on the second end. The peripheral delimiter extends advantageously in a helical manner at least in a part section. In the part section, the distance between the peripheral delimiter and the rotational axis of the fan wheel increases, in this case, advantageously in the rotational direction of the fan wheel.

BRIEF DESCRIPTION OF THE DRAWINGS

The invention will now be described with reference to the drawings wherein:

FIG. 6 shows a sectional representation of a cutout through the engine housing and the muffler;

FIG. 7 shows a sectional representation of a cutout through the engine housing with a fan wheel arranged thereon along the line VII-VII in FIG. 6;

DESCRIPTION OF THE PREFERRED EMBODIMENTS OF THE INVENTION

Figure 1:
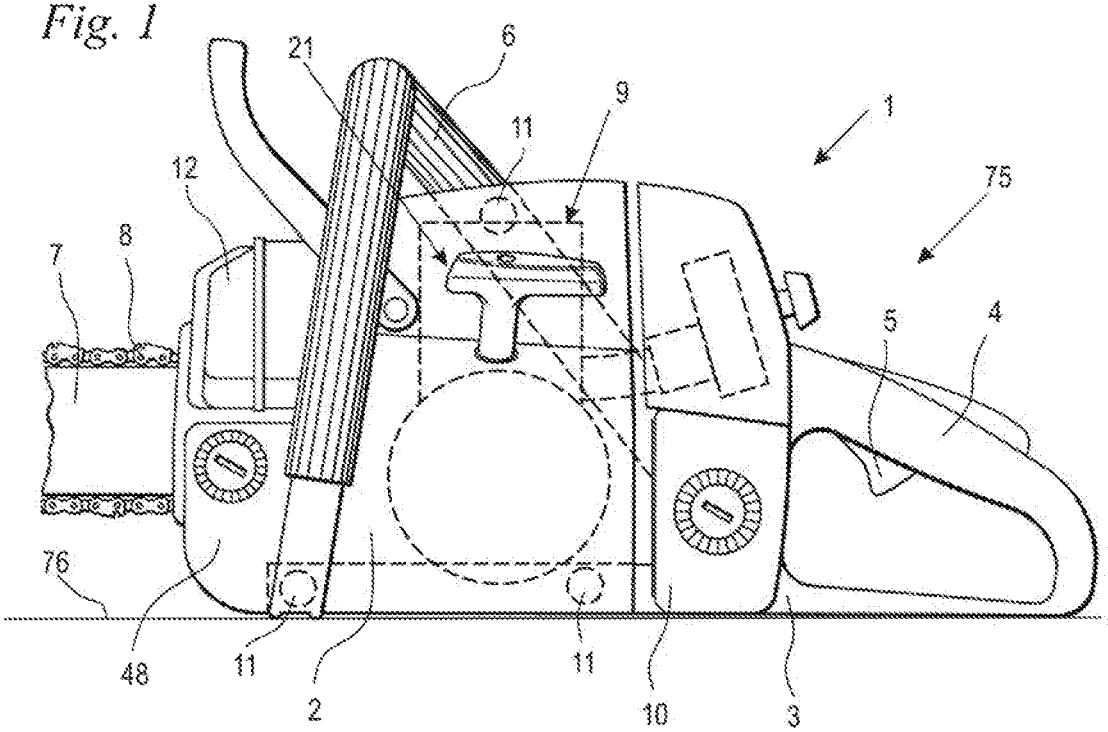
FIG. 1 shows a perspective representation of a handheld work apparatus in a rest position.

FIG. 1 shows a power saw as an embodiment of a handheld work apparatus 1. However, the work apparatus can also be another handheld, in a preferred manner portable, work apparatus 1, such as, for example, an angle grinder, a brushcutter, a blower or the like. The work apparatus 1 includes an engine housing 2 and a handle housing 3 which are connected together via multiple anti-vibration elements 11 which are shown schematically in FIG. 1. The work apparatus has a combustion engine 9 which can be realized in part in one piece with the engine housing 2. The combustion engine 9 serves for driving a tool of the work apparatus 1. The combustion engine is advantageously a two-stroke engine. In the embodiment, the tool is a saw chain 8 which is arranged so as to circulate on a guide bar 7 which is held on the engine housing 2.

The work apparatus 1 includes a rear handle 4 and a bale handle 6 for guiding the work apparatus 1 in operation. In the embodiment, the rear handle 4 and the bale handle 6 are part of the handle housing 3 and, as a result, are decoupled from the vibrations of the combustion engine 9 via the anti-vibration elements 11. A throttle lever 5 is pivotably mounted on the rear handle 4. The work apparatus 1 additionally has two operating means tanks, namely a fuel tank 10 and an oil tank 48. In the embodiment, the fuel tank 10 is realized on the handle housing 3. The oil tank 48 is realized on the engine housing 2. The combustion engine 9 includes a muffler 12. The muffler 12 is advantageously arranged on the side of the work apparatus 1 remote from the rear handle 4.

FIG. 1 shows the work apparatus 1 in a rest position 75. In the rest position 75, the work apparatus 1 stands by way of a bottom side, which is provided for resting the work apparatus, or with support feet, which are provided for this purpose, on a flat, horizontally aligned rest surface 76. The rest position 75 is a stable position of the work apparatus 1 in which the rear handle 4 and the bale handle 6 are easily accessible to the operator. The work apparatus 1 includes a starting device 21 for starting the combustion engine 9. In the embodiment, the starting device 21 is realized as a hand-actuated pull starter. An electrically-actuated starting device 21 can also be advantageous.

Figure 2:
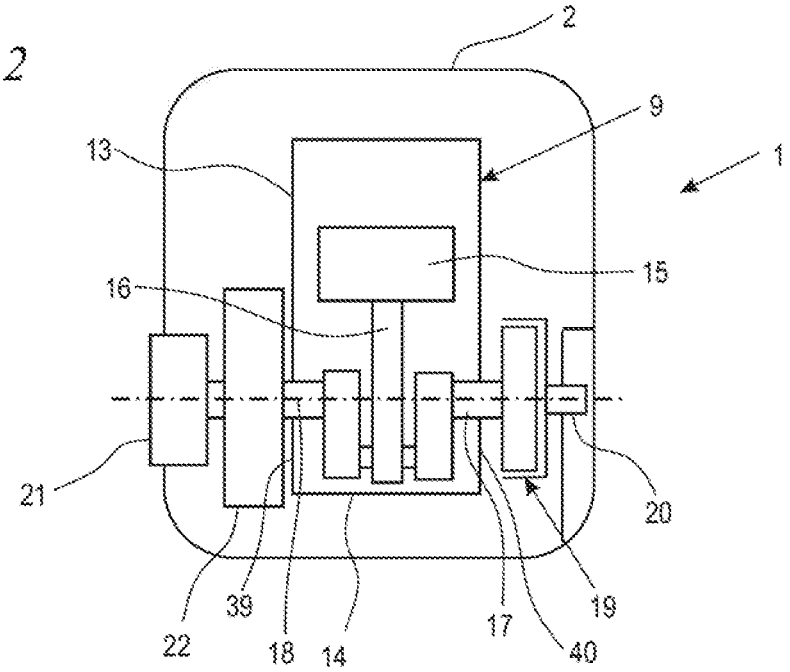
FIG. 2 shows a schematic sectional representation through the drive train of the work apparatus from FIG. 1.

FIG. 2 shows the drive unit of the work apparatus 1 in detail. The combustion engine 9 includes a cylinder 13 and a crankcase 14. A piston 15 is mounted so as to move back and forth in the cylinder 13. The piston 15 drives a crank shaft 17, which is mounted in the crankcase 14 so as to be rotatable about a rotational axis 18, via a connecting rod 16. The crank shaft 17 is connected via a centrifugal clutch 19 to a drive pinion 20 which drives the saw chain 8. A fan wheel 22 is also non-rotatably connected to the crank shaft 17. The starter device 21 acts on the crank shaft 17.

In the embodiment, the centrifugal clutch 19 and the drive pinion 20 are arranged on one side of the crankcase 14 and the fan wheel 22 and the starter device 21 are arranged on the opposite side of the crankcase 14.

Figure 3:
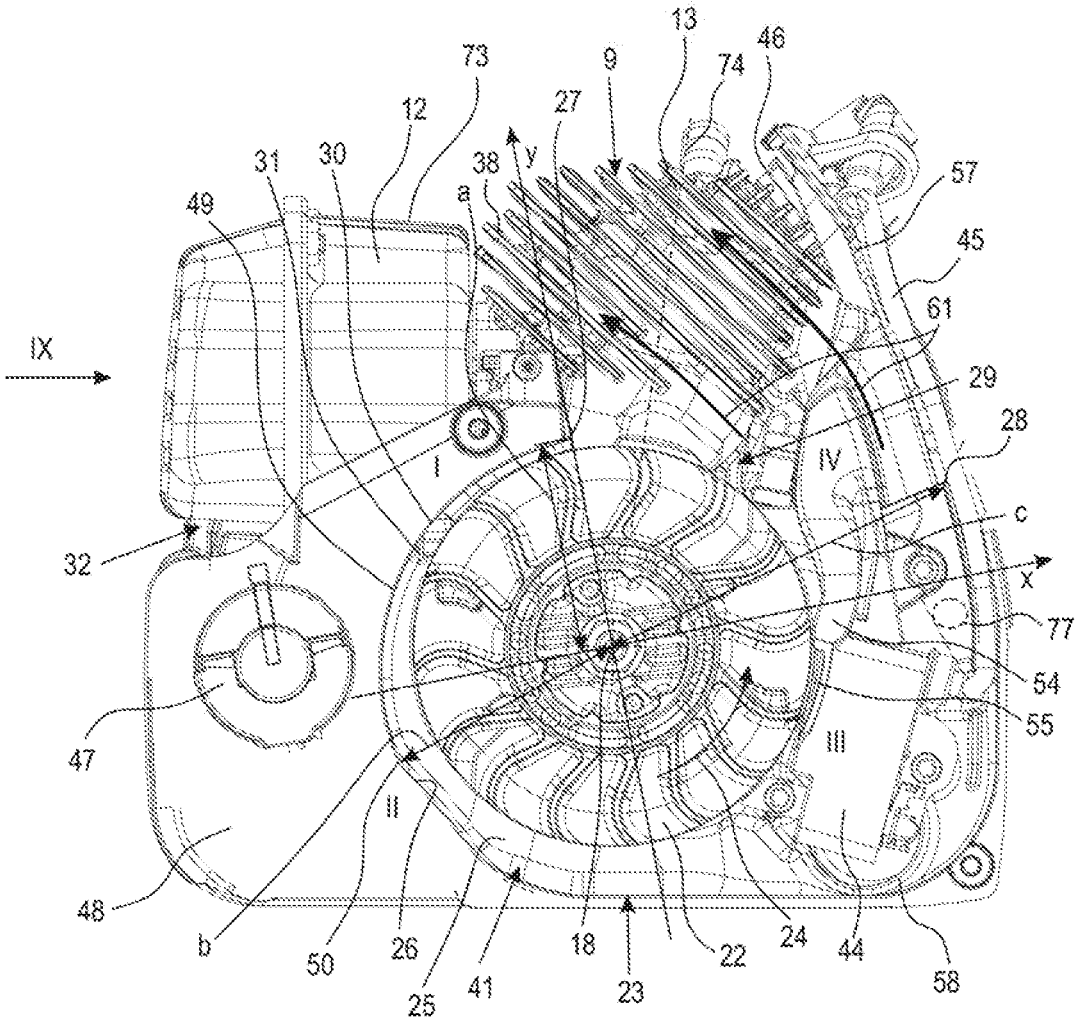
FIG. 3 shows a side view of a cutout of the engine housing of the work apparatus from FIG. 1 with cylinder and muffler, a cover of the fan wheel housing having been removed.

Cooling air is conveyed by the fan wheel 22 in operation to cool the combustion engine 9. FIG. 3 shows the configuration of the cooling air conveying means in detail. As shown in FIG. 3, the fan wheel 22 is arranged in a fan wheel housing 23. The fan wheel housing 23 is delimited by a rear wall 25, which faces the crankcase 14 (FIG. 2) which is not shown in FIG. 3, and a peripheral delimiter 26. In addition, a covering hood (not shown) covers the fan wheel housing 23 in an advantageous manner. The covering hood advantageously includes air vents for cooling air which is drawn-in by the fan wheel 22. The peripheral delimiter 26 is advantageously realized as a peripheral wall. The fan wheel 22 is driven in a rotational direction 24 in operation. In the embodiment, the rotational direction 24 extends in the view shown in FIG. 3 in the direction of view parallel to the rotational axis 18 and from the fan wheel 22 toward the crankcase 14 in an anticlockwise manner. The peripheral delimiter 26 includes a first end 27 and a second end 28. The peripheral delimiter 26 extends from the first end 27 in the rotational direction 24 up to the second end 28, in an advantageous manner largely interruption-free. However, it can also be provided that the peripheral delimiter 26 is interrupted between the first end 27 and the second end 28 or is composed of multiple sections. An outlet 29 is realized in the rotational direction 24 from the second end 28 to the first end 27. The outlet 29 is delimited by the first end 27 and the second end 28. In an advantageous manner, no section of the peripheral delimiter 26 is arranged in the outlet 29 so that the outlet 29 is not interrupted by the peripheral delimiter 26.

Cooling air conveyed by the fan wheel 22 flows in operation through the outlet 29 to the cylinder 13 of the combustion engine 9. The cylinder 13 has a plurality of cylinder cooling ribs 38 which, in the embodiment, extend in an inclined manner with respect to a cylinder longitudinal axis 74. The cooling air flows from the outlet 29 to the cylinder 13 approximately in the direction of arrows 61 which are marked schematically in FIG. 3. Part of the cooling air can flow advantageously from the cylinder 13 to a top side 73 of the muffler 12. The top side 73 of the muffler 12 is the side which lies remote from the rest surface 76 in the rest position 75.

The peripheral delimiter 26 and the rear wall 25 of the fan wheel housing 23 delimit an interior space 41 of the fan wheel housing 23. The fan wheel 22 is arranged in the interior space 41. The outlet 29 leads out of the interior space 41. The peripheral delimiter 26 extends at least in a part section 49 in a helical manner about the rotational axis 18 of the crank shaft 17 (FIG. 2). In the embodiment, the helical part section 49 extends in the rotational direction 24 from the first end 27 to a region 50. In the embodiment, the part section 49 extends via a peripheral angle about the rotational axis 18 of approximately more than 90°. The distance between the peripheral delimiter 26 and the rotational axis 18 increases in the part section 49. At the first end 27, the peripheral delimiter 26 is at a distance a from the rotational axis 18. At the region 50, the peripheral delimiter 26 is at a distance b from the rotational axis 18. The distance b in the region 50 is advantageously greater than the distance a in the part section 49.

FIG. 3 also shows a system of coordinates with axes x and y. In the side view shown, when looking parallel to the rotational axis 18 of the crank shaft 17 (FIG. 2), the origin of the system of coordinates rests on the rotational axis 18. The y axis extends to the second end 27 in the direction of the rotational axis 18. The x axis is arranged at right angles thereto. The x axis is aligned such that the positive x axis, after pivoting about 90° anticlockwise, moves into coincidence with the positive y axis. The x and y axes divide the work apparatus 1 into four sectors I, II, III and IV. The sector I is delimited by the positive y axis and the negative x axis, the sector II by the negative x axis and the negative y axis, the sector III by the positive x axis and the negative y axis and the sector IV by the positive x axis and the positive y axis. The outlet 29 extends at least in part, in the embodiment completely, in the fourth sector IV. The second end 28 of the peripheral delimiter 26 is arranged in the fourth sector IV in the embodiment. The helical part section 49 of the peripheral delimiter 26 extends in the first sector I. In the embodiment, the part section 49 extends into the second sector II. It can also be provided that the helical part section 49 extends into the third sector III or up to the second end 28. The muffler 12 is advantageously arranged in the first sector I. The oil tank 48 extends in the first sector I and in the second sector II. FIG. 3 also shows a tank cover 47 of the oil tank 48.

As shown in FIG. 3, an ignition module 44, which is connected via an ignition cable 45 to a spark plug 46 which projects into a combustion chamber of the combustion engine 9, is arranged in the third sector III. The fan wheel 22 carries magnets which are not shown in FIG. 3 and which induce the ignition voltage for the spark plug 46 in the ignition module 44.

The second end 28 is at a distance c, which is greater than the distance a and also greater than the distance b, from the rotational axis 18 of the crank shaft 17 (FIG. 2). It can be provided that the distance c is the largest distance between the peripheral delimiter 26 and the rotational axis 18. In the embodiment, however, the peripheral delimiter 26 is at an even greater distance from the rotational axis 18 in the region of the ignition module 44 as in the region the flow cross section in the fan wheel housing 23 is reduced on account of the ignition module 44. The rear wall 25 is advantageously realized in a closed manner except for one or more throughflow-openings for cooling air which will be described in more detail below. The receiving opening 58 for an anti-vibration element 11 realized in the rear wall 25 and shown in FIG. 3 is closed advantageously by the anti-vibration element.

As shown in FIG. 3, the rear wall 25 has a throughflow-opening 30. The throughflow-opening 30 is realized separately from the outlet 29. Additional cooling air is directed to the muffler 12 through the throughflow-opening 30. The throughflow-opening 30 is an additional opening for cooling air. The muffler 12 is arranged in a muffler space 32 into which the throughflow-opening 30 opens out.

An elevation 31 is advantageously arranged on the side 79 (FIG. 4) of the throughflow-opening 30 located behind the throughflow-opening 30 with reference to the rotational direction 24. The elevation 31 includes an approximately triangular cross section in the side view shown in FIG. 3.

As also shown in FIG. 3, a partition wall 57, which separates a suction chamber (not shown in FIG. 3) of the combustion engine 9 from the cylinder 13, connects to the peripheral delimiter 26 on the second end 28. An air filter and the fuel supply are advantageously arranged in the suction chamber. The fuel supply can be effected advantageously via a carburetor arranged in the suction chamber or via a fuel valve. The fuel valve can also be arranged in the suction chamber. A cooling air opening 77, shown by the dotted line in FIG. 3, can be provided in the rear wall 25 for cooling the suction chamber and/or for cooling a fuel valve. The cooling air opening 77 is advantageously arranged in the third sector III and/or fourth sector IV and is situated therefore clearly closer to the second end 28 than to the first end 27.

Figure 4:
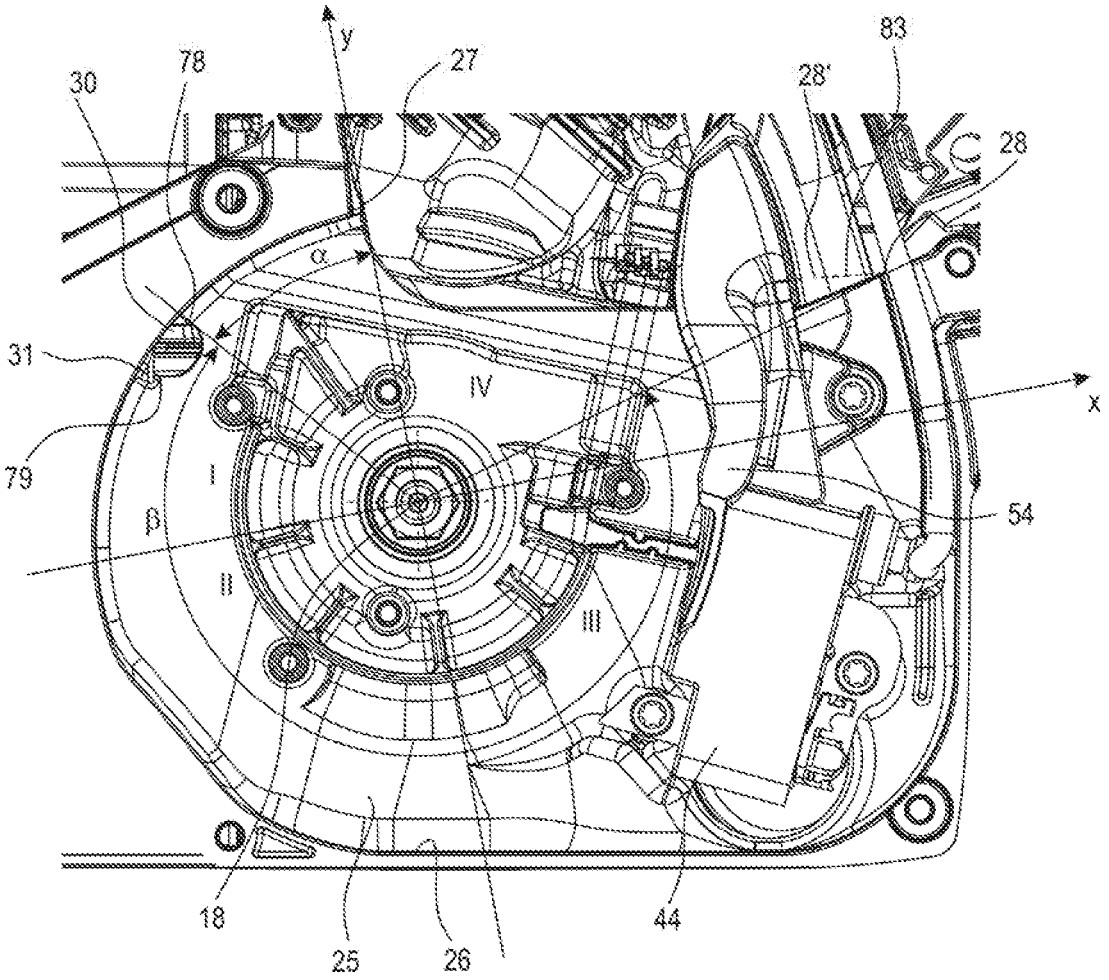
FIG. 4 shows a side view of the engine housing corresponding to the representation from FIG. 3, the fan wheel not being shown.

FIG. 4 shows the side view of a cutout of the engine housing 2 from FIG. 3 and without a fan wheel 22 arranged in the fan wheel housing 23. As shown in FIG. 4, the first end 27 is at an angular distance α from the throughflow-opening 30. The angular distance α, in this case, is measured in the rotational direction 24 proceeding from the first end 27 up to the forward side 78 of the throughflow-opening 30 in the rotational direction 24. The angular distance α is advantageously less than 120°, in particular less than 90° and in a preferred manner less than 60°. In the embodiment, the angular distance α is less than 50°. The angular distance ß, measured in the rotational direction 24 proceeding from the throughflow-opening 30 between the throughflow-opening 30 and the second end 28 is clearly greater than the angular distance α. The angular distance ß, in this case, is measured from the rearward side 79 of the throughflow-opening 30 in the rotational direction to the second end 28 of the peripheral delimiter 26. The angular distance ß is advantageously more than 90°, in particular more than 180°. In the embodiment, the angular distance ß is more than 210°. As is also shown in FIG. 4, the elevation 31 is arranged adjacent to the rearward side 79 of the throughflow-opening 30. FIG. 4 also shows an air-guidance 54 which is arranged in the fan wheel housing 23 and will be described in more detail below.

As FIG. 4 shows schematically by way of a broken line, in an advantageous realization variant a section of the peripheral delimiter 26 can be formed by a guide element 83 which projects into the fan wheel housing 23. The guide element 83 projects in particular approximately in the direction of the rotational axis 18 of the crank shaft 17 or in the direction of the first end 27. The guide element 83 reduces the free flow cross section of the outlet 29. The second end 28' of the peripheral delimiter 26 is realized on the guide element 83. In this realization variant, the outlet 29 extends in the rotational direction from the second end 28' to the first end 27.

Figure 5:
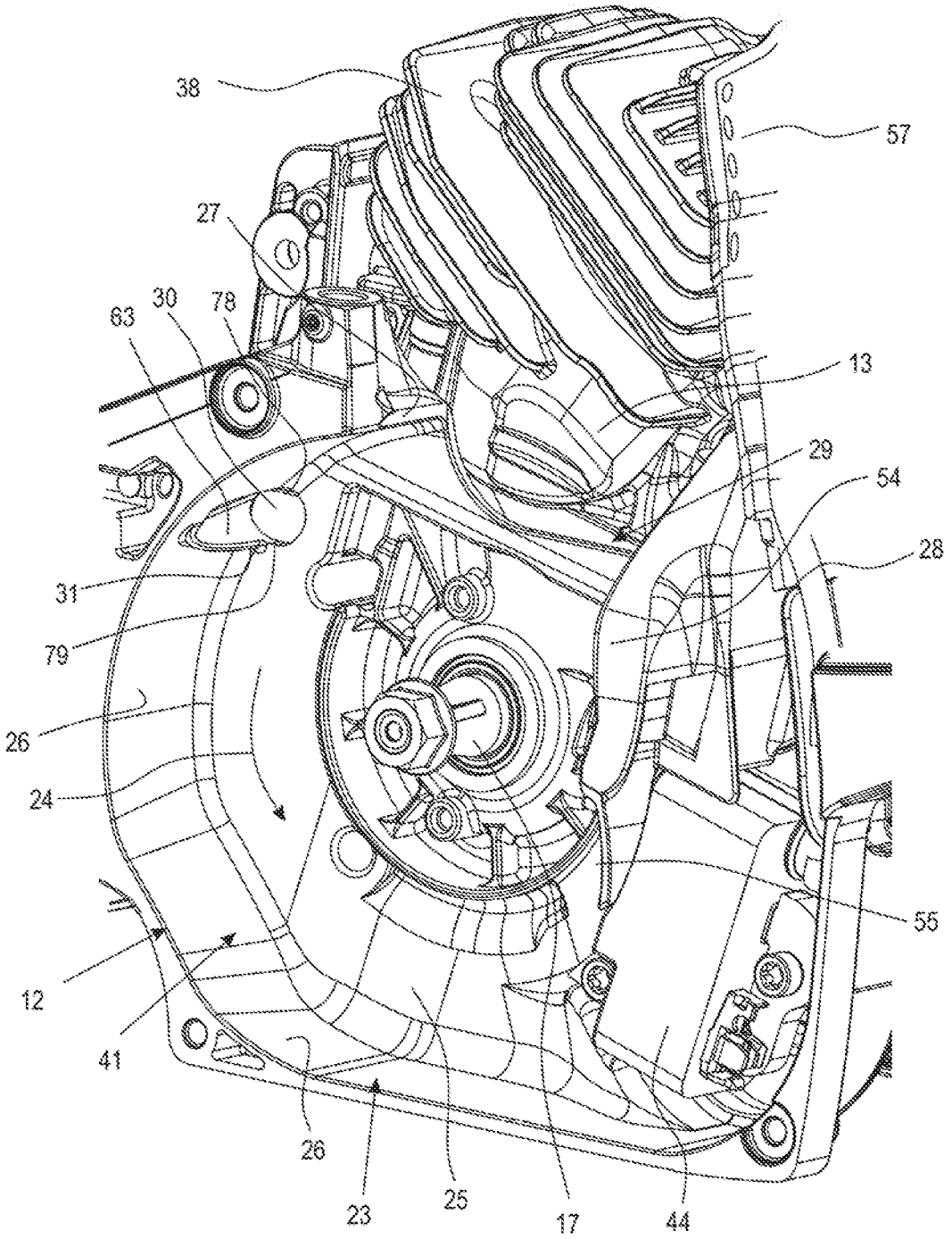
FIG. 5 shows a perspective representation of a cutout of the engine housing looking into the fan wheel housing, the fan wheel not being shown.

As shown in FIG. 4, when seen in the viewing direction parallel to the rotational axis 18 of the crank shaft 17, the elevation 31 includes an approximately triangular shape. FIG. 5 shows the configuration of the elevation 31 in detail. The elevation 31 includes a forward contour 63 in the rotational direction 24. The contour 63 corresponds advantageously to the peripheral embodiment of the throughflow-opening 30 and preferably merges into the peripheral wall of the throughflow-opening 30. The contour 63 is realized as a flow-directing element which forks off part of the cooling air conveyed by the fan wheel 22. The elevation 31, in this case, can extend advantageously over up to 50% of the free flow cross section between the peripheral delimiter 26 and the fan wheel 22 at the throughflow-opening 30. In an advantageous configuration, the width of the elevation decreases as the distance from the rear wall 25 of the fan wheel housing 23 increases. The elevation 31 becomes accordingly narrower as the distance from the rear wall 25 increases. In an advantageous configuration, the elevation includes an approximately triangular shape in the viewing direction approximately in the peripheral direction and approximately parallel to the peripheral delimiter 26 at the throughflow-opening 30. With a viewing direction in the rest position 75 (FIG. 1) perpendicularly downward, an approximately triangular shape of the elevation 31 is advantageously produced.

As also shown in FIG. 5, the air-guidance component 54 extends predominantly in the fourth sector IV and projects into the third sector III. As shown in FIG. 5, an air inlet 55 is realized on the air-guidance component 54, via which air inlet the air of combustion is forked off out of a region of the interior space 41 of the fan wheel housing 23, in which the air includes little contamination. The clean air of combustion is guided into the suction chamber (not shown) via the air-guidance 54. Fuel for the operation of the combustion engine is then supplied to the air of combustion in operation. In the embodiment, the air-guidance 54 projects through the outlet 29 and, as a result, reduces the free flow cross section of the outlet 29.

As shown in the sectional representation in FIG. 6, the throughflow-opening 30 opens out into the muffler space 32. The muffler 12 has a bottom side 80 which, in the rest position 75 (FIG. 1), is the region of the muffler 12 which is at the smallest distance from the rest surface 76. An intermediate space 35 is formed between the bottom side 80 and the engine housing 2. The intermediate space 35 is delimited by a wall 34 of the engine housing 2. In the embodiment, the wall 34 is a wall of the oil tank 48. A cooling rib 51, which will be described in more detail below, can be seen through the throughflow-opening 30.

Figure 9:
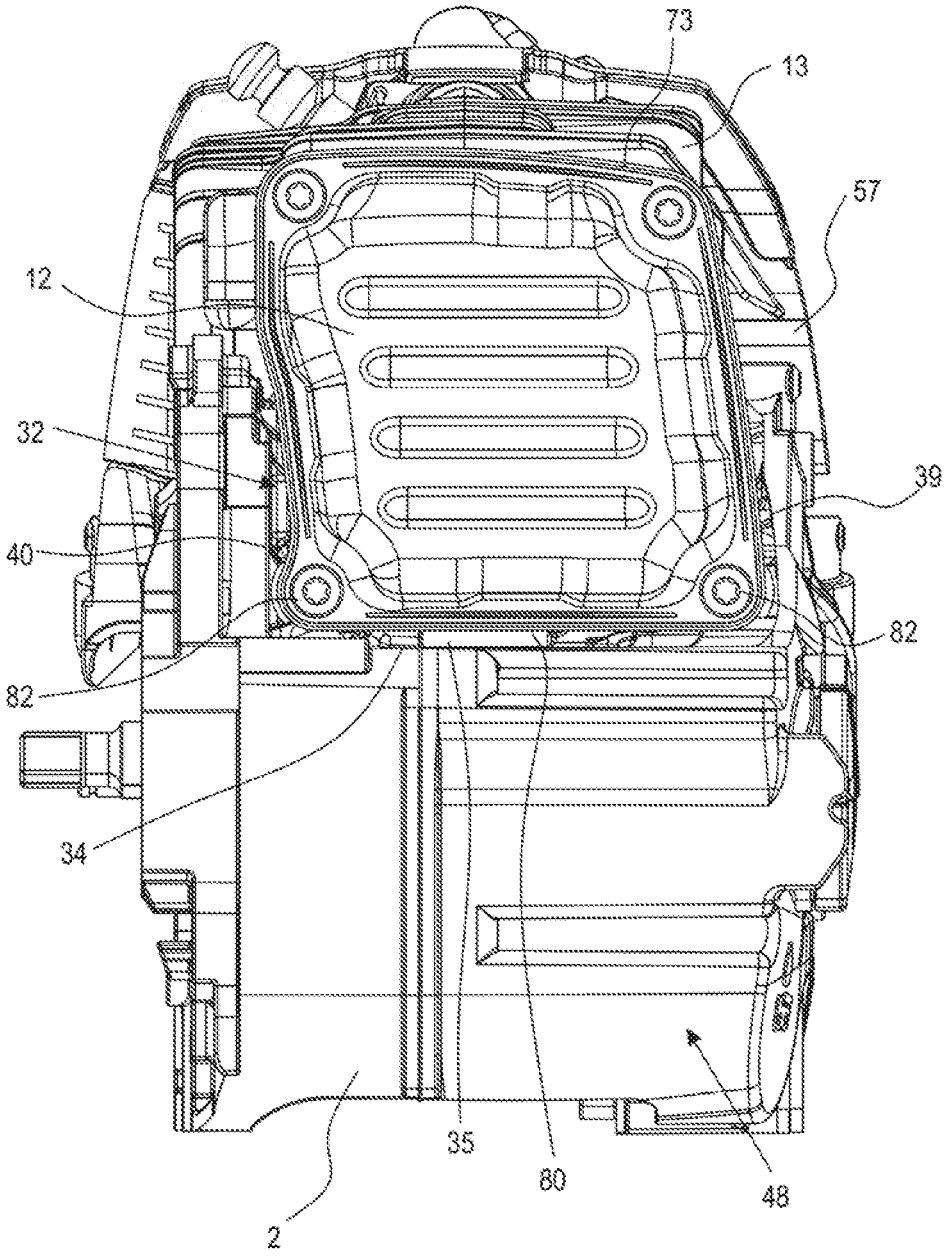
FIG. 9 shows a side view in the direction of the arrow X in FIG. 3.

As shown in FIG. 7, the cooling air emerges from the interior space 41 of the fan wheel housing 23 through the throughflow-opening 30 into the muffler space 32 in a direction of flow which is schematically indicated by an arrow 62. The muffler 12 is screw-connected to fastening domes 59 of the engine housing 2 (FIG. 7) adjacent to its bottom side 80 (FIG. 6). To this end, muffler screws 82, which are shown in FIG. 9, are screwed into the fastening domes 59. In the embodiment, the fastening domes 59 are arranged in the intermediate space 35. As is also shown in FIG. 7, the muffler space 32 is delimited by a first transverse side 39 and a second transverse side 40. The first transverse side 39 is adjacent to the fan wheel housing 23. The second transverse side 40 is on the opposite side, that is, adjacent to the guide bar 7 (FIG. 1) not shown in FIG. 7. The transverse sides 39 and 40 extend on the opposite longitudinal sides of the work apparatus 1. In the embodiment, the transverse sides 39 and 40 are part of the engine housing 2. The transverse sides 39 and 40 of the muffler space 32 are advantageously integrally molded on the crankcase 14 and extend as an extension of the transverse sides of the crankcase 14.

The fastening domes 59 are fixed on the transverse sides 39 and 49 of the muffler space 32. The fastening domes 59 and the muffler screws 82 are cooled via the air flowing in through the throughflow-opening 30 into the muffler space 32.

As shown in FIG. 7, the crankcase 14 has a wall section 56 which delimits the muffler space 32. The wall section 56 delimits the crankcase interior space 81 at the same time. The cylinder 13 (FIG. 2) is fixed on the crankcase 14 via cylinder foot screws 37 which are screwed into bores 36 of the crankcase 14. FIG. 7 shows three of the four cylinder foot screws 37. At least one cooling rib 51 is arranged on the outside of the wall section 56 delimiting the muffler space 32. The at least one cooling rib 51 is advantageously integrally molded on the wall section 56. In a particularly advantageous manner, the at least one cooling rib 51 is arranged adjacent to a bore 36. Improved cooling of the cylinder foot screws 37 is achieved as a result. In a preferred manner, the cooling rib 51 projects into the muffler space 32. The cooling rib 51 extends in the embodiment up to the transverse side 40 and is at a distance from the transverse side 39. The stability of the engine housing 2 is increased at the same time via the cooling rib 51.

Figure 8:
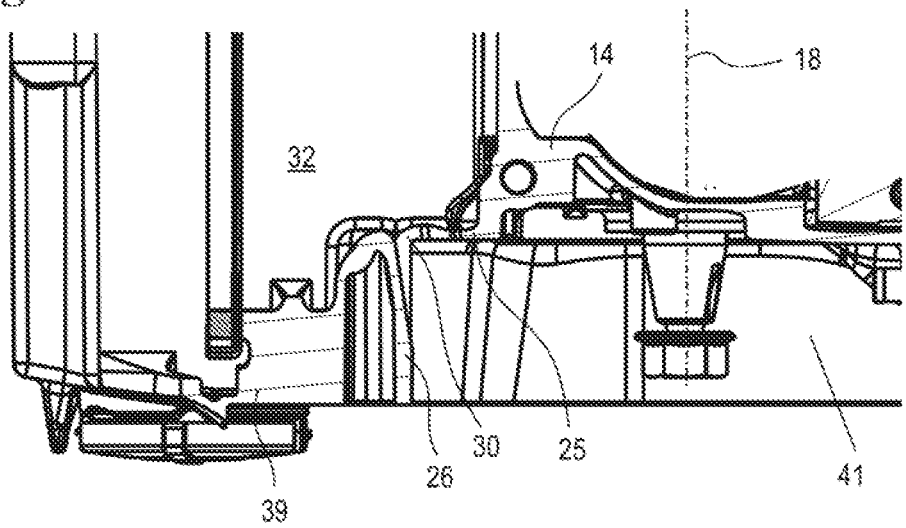
FIG. 8 shows a sectional representation corresponding to FIG. 7, the fan wheel not being shown.

FIGS. 7 and 8 also show the configuration of the throughflow-opening 30 in detail. In the embodiment, the throughflow-opening 30 extends both into the rear wall 25 and into the peripheral delimiter 26. As a result, the cooling air flows out of the interior space 41 in a direction which is inclined with respect to the rotational axis 18 into the muffler space 32. The vector of the flow direction has accordingly both directional components parallel to the rotational axis 18 and directional components perpendicular to the rotational axis 18. As a result of the alignment of the flow direction, both the cylinder foot screws 37 and the muffler screws 82 are able to be cooled well by the cooling air flowing into the muffler space 32.

Figure 8A:
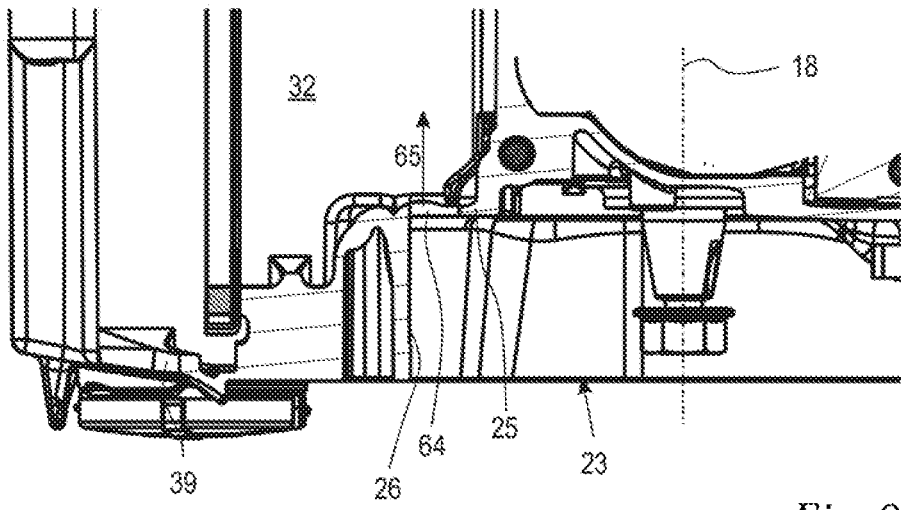
FIGS. 8A and 8B show realization variants in representations corresponding to FIG. 8.
Figure 8B:
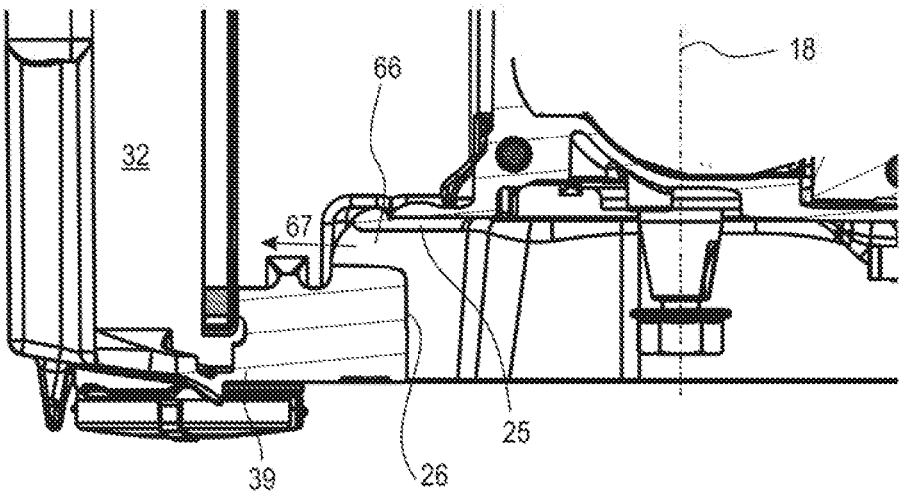

FIGS. 8A and 8B show alternative configurations of the throughflow-opening. FIG. 8A shows a throughflow-opening 64 which extends exclusively into the rear wall 25. In the case of this configuration, the cooling air flows in the direction of an arrow 65 approximately parallel to the rotational axis 18 into the muffler space 32. The arrow 65, which corresponds to the vector of the main flow direction, does not have any directional components or only very small directional components perpendicular to the rotational axis 18.

In the case of the embodiment according to FIG. 8B, a throughflow-opening 66 is provided which extends exclusively in the peripheral delimiter 26. As a result of the throughflow-opening 66, the cooling air flows in the direction of an arrow 67 which is directed approximately perpendicular to the rotational axis 18. The arrow 67 is the vector of the main flow direction and does not have any directional components or only very small directional components parallel to the rotational axis 18. By changing the position of the throughflow-opening 30, 64, 66, the main flow direction of the cooling air emerging into the muffler space 32 is able to be modified. In a particularly advantageous configuration, the throughflow-opening 30, 64 extends at least in part into the rear wall 25 so that the muffler 12 is cooled in the region of its bottom side 80 over its entire width.

FIG. 9 shows the arrangement of the muffler 12 in the muffler space 32. As FIG. 9 shows, the intermediate space 35 is formed between the bottom side 80 and the wall 34 of the oil tank 48. The muffler 12 broadly fills the muffler space 32 between the transverse sides 39 and 40 so that an approximately uniform gap is formed around the muffler 12, through which the cooling air is able to flow.

Figure 10:
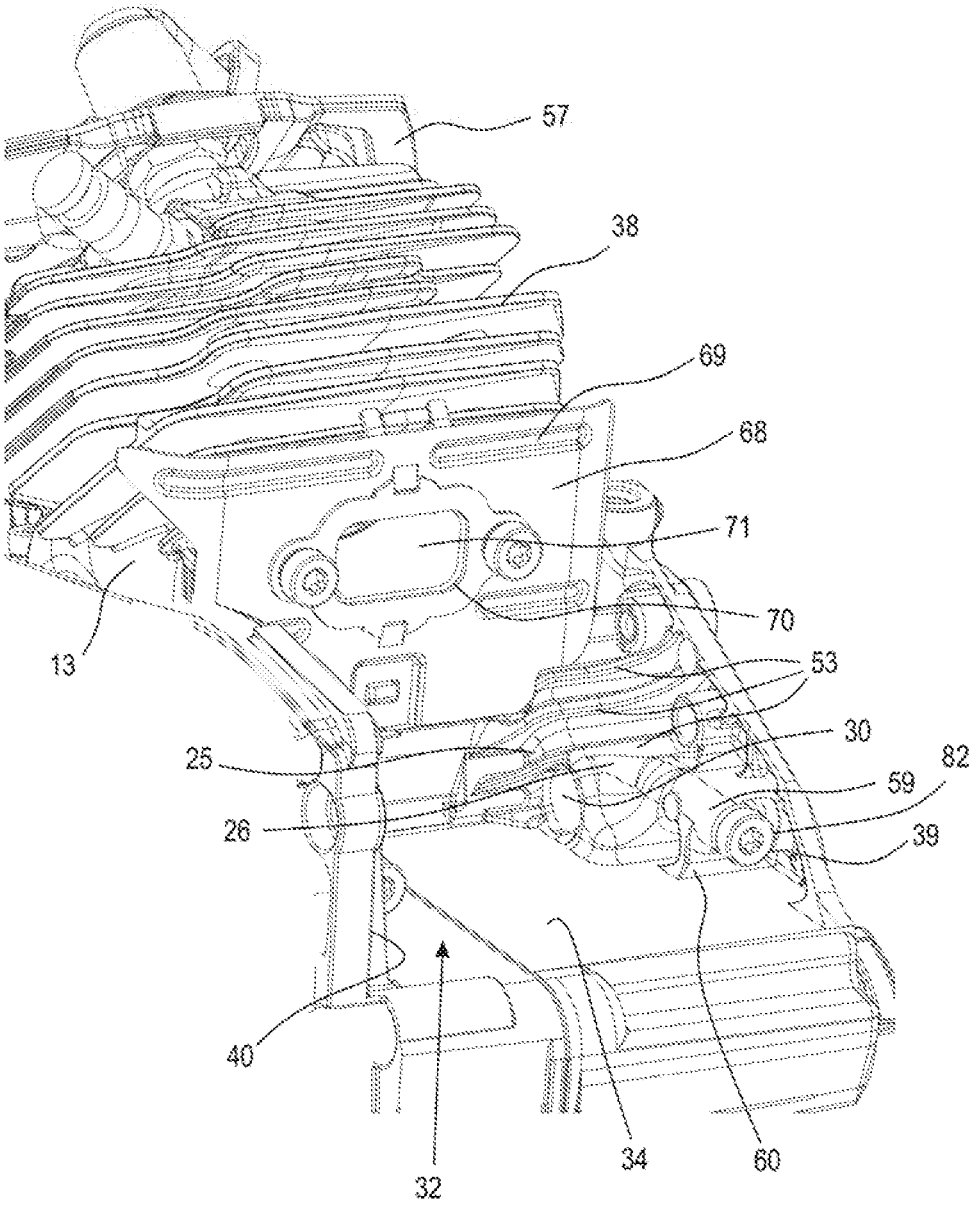
FIG. 10 shows a perspective representation of the muffler space, the muffler not being shown.

As shown in FIG. 10, a muffler sheet metal 68 is fixed on the cylinder 13. The muffler sheet metal 68 has an opening 70 which is arranged at an outlet 71 of the cylinder 13. The exhaust gases of the combustion engine 9 emerge out of the cylinder 13 through the opening 70 into the muffler 12 (FIG. 9). The muffler sheet metal 68 has multiple reinforcing corrugations 69 to increase stability. As shown in FIG. 10, the muffler sheet metal 68 protrudes laterally up to the transverse sides 39 and 40. A passage of cooling air from the cylinder 13 directly to the bottom side 80 (FIG. 9) of the muffler 12 is largely avoided as a result. The bottom side 80 of the muffler 12 is cooled via cooling air which passes through the throughflow-opening 30 directly out of the interior space 41 of the fan wheel housing 23 into the muffler space 32. The cooling of the bottom side 80 of the muffler 12 is effected accordingly with cooling air which has not been preheated beforehand. The cylinder 13 and the bottom side 80 of the muffler 12 are cooled by cooling air flows which are separate from one another.

FIG. 10 also shows the partition wall 57 to the suction chamber. As is also shown in FIG. 10, the fastening dome 59, which is held on the wall 34 and the transverse side 39 of the muffler space 32, has a cooling rib 60 by way of which it is supported on the wall 34. The fastening dome 59, not shown in FIG. 10, on the transverse side 40 is provided with a cooling rib 60 in a corresponding manner. As a result, on the one hand the stability of the connection of the fastening dome 59 is increased and on the other hand improved cooling of the fastening dome 59 is achieved. As FIG. 10 also shows, further cooling ribs 53 are provided on the transverse side 39. The cooling ribs 53 are guided along the outside of the peripheral delimiter 26 and the rear wall 25 of the fan wheel housing 23 and improve the cooling on the transverse side 39. The longitudinal direction of the cooling ribs 53 extends approximately parallel to the rotational axis 18. The cooling ribs 53 project from the rear side of the rear wall 25 and the peripheral delimiter 26 into the muffler space 32.

Figure 11:
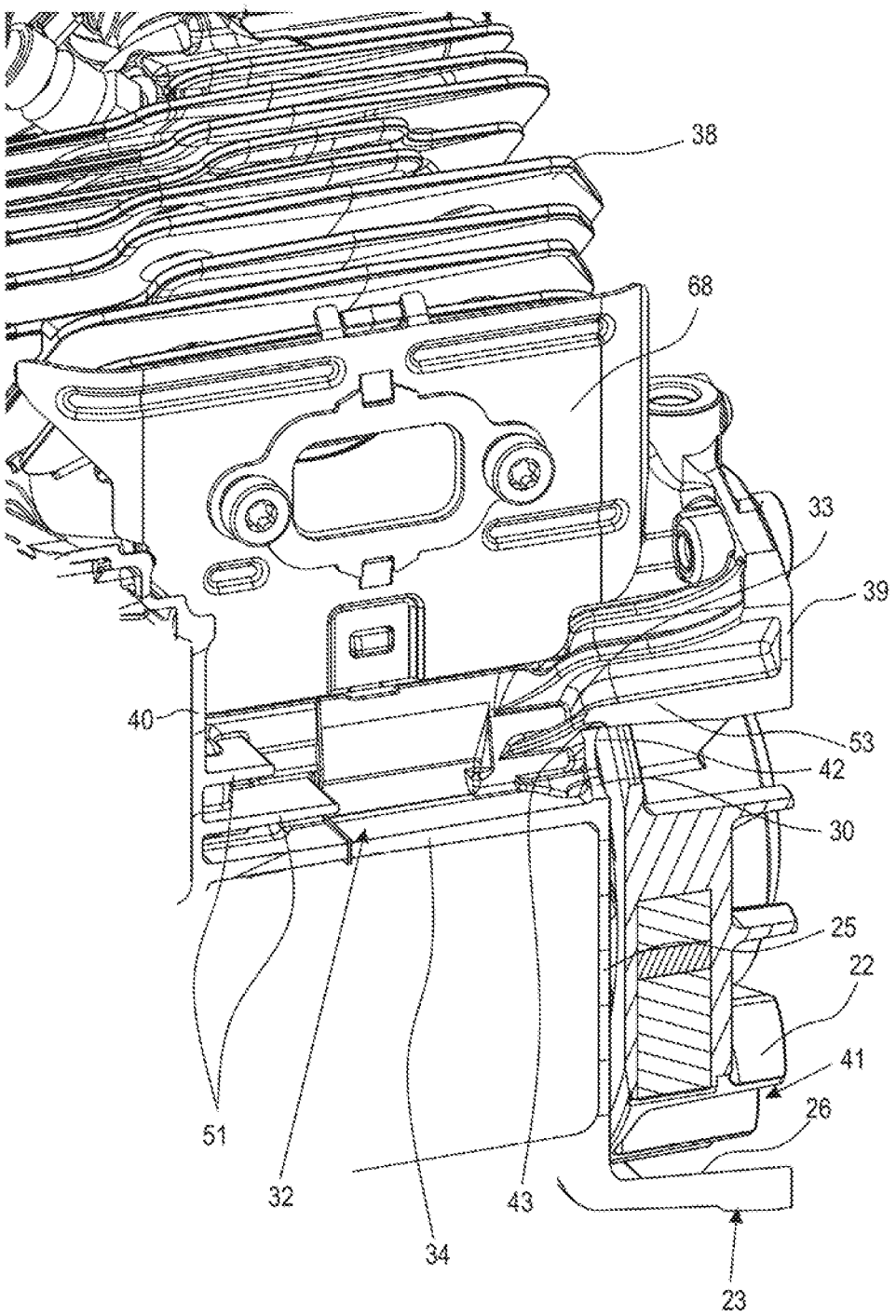
FIG. 11 shows a perspective sectional representation through the muffler space and the engine housing.

FIG. 11 shows the arrangement of the cooling ribs 51 on the transverse side 40 and the arrangement of the cooling ribs 53 on the opposite transverse side 39. As FIG. 11 also shows, the throughflow-opening 30 is arranged in a section 33 of the rear wall 25 which delimits the interior space 41 of the fan wheel housing 23 with one side 42 and the muffler space 32 with the opposite side 43. As a result, the air flows out of the interior space 41 through the section 33 of the rear wall 25 directly into the muffler space 32.

Figure 12:
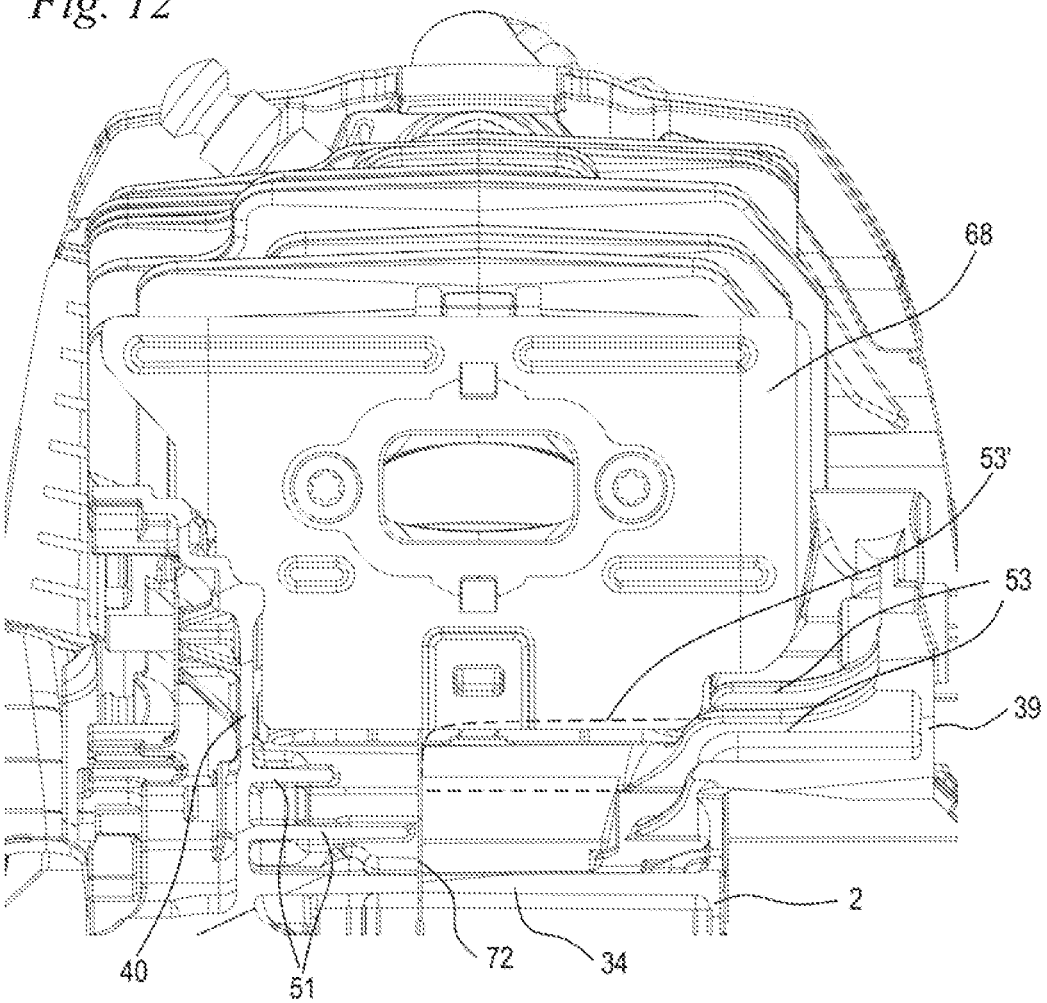
FIG. 12 shows a sectional representation through the muffler space.

As shown in FIG. 12, the engine housing 2 has a partition plane 72. Two cooling ribs 51 are provided in the embodiment. The cooling rib 51, which is arranged adjacent to the wall 34, extends up to approximately the partition plane 72. The cooling rib 51, which is further away from the wall 34, is realized in a shorter manner and does not extend in the embodiment up to the partition plane 72. The cooling ribs 53 are realized in a comparatively short manner in the embodiment and end at a distance from the partition plane 72. However, it is also possible to provide schematically shown cooling ribs 53' which extend further in the direction of the transverse side 40, preferably up to approximately the partition plane 72.

Figure 13:
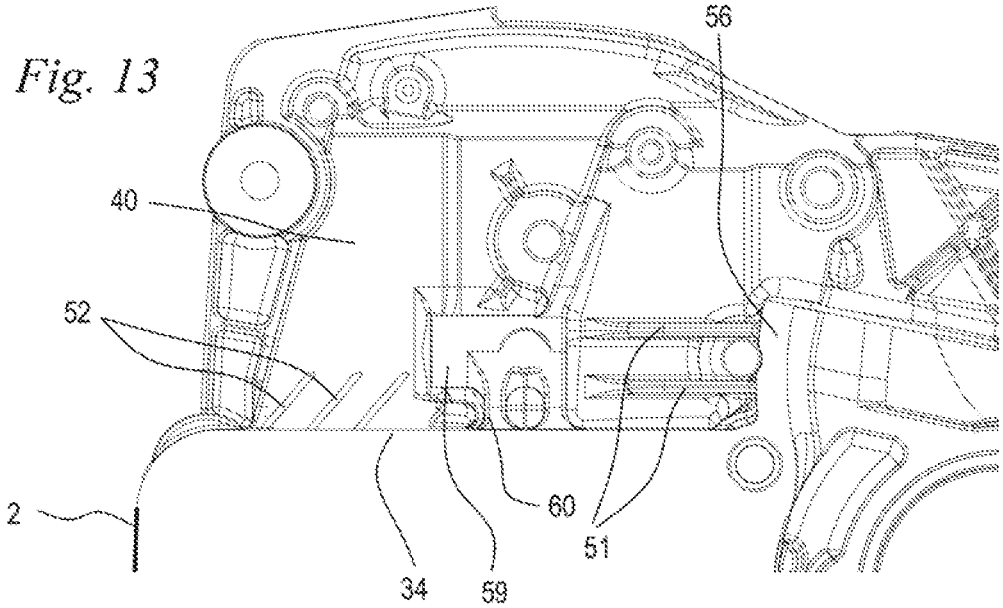
FIG. 13 shows a schematic side view of a cutout of the transverse side of the muffler space remote from the fan wheel.

FIG. 13 shows a side view of the transverse side 40 when seen from the opposite transverse side 39. As FIG. 13 shows, the cooling ribs 51 project close to the fastening dome 59 of the muffler 12. FIG. 13 also shows the cooling rib 60 on the fastening dome 59 on the second transverse side 40. As FIG. 13 also shows, the wall 34 can also carry further cooling ribs 52 which are shown schematically in FIG. 13. The cooling ribs 52 project from the wall 34 into the muffler space 32. The cooling ribs 52 are inclined with respect to the wall 34 in a preferred manner by an angle of less than 90°. The inclination of the cooling ribs 52, in this case, is provided advantageously such that the cooling ribs 52 are at a smaller distance from the wall section 56 of the crankcase 14 as the distance from the wall 34 increases.

In the embodiment, the cooling ribs 51 extend parallel to the wall 34 of the muffler space 32, whilst the cylinder cooling ribs 38 extend inclined thereto. This can be seen in particular in FIG. 6. The cooling ribs 51, which are integrally molded on the crankcase 14, accordingly do not extend parallel to the cylinder cooling ribs 38.

As a result of the wall 34 carrying the fastening domes 59 for the muffler 12, the fastening domes 59 are cooled well via the cooling air flow emerging through the throughflow-opening 30. In the embodiment, the cooling ribs 51, 52, 53, 53' are realized as elongated ribs. However, cruciform cooling ribs or cooling ribs formed in another manner can also be advantageous.

The throughflow-opening 30 enables largely separate cooling air flows for the cylinder 13 and the muffler 12, in particular for the bottom side 80 of the muffler 12. Improved cooling of the muffler 12 is achieved as a result. By the throughflow-opening 30 only being at a small peripheral distance from the first end 27 of the peripheral delimiter 26, the throughflow-opening 30 does not produce a decrease in the air volume conveyed through the outlet 29, but rather an increase in the total air volume conveyed with the fan wheel 22.

The throughflow-opening 30 is advantageously clearly smaller than the outlet 29. In a preferred manner, the flow cross section of the throughflow-opening 30 is less than 50%, in particular less than 30% of the outlet 29. In an advantageous manner, the flow cross section of the throughflow-opening 30 is less than 16 $cm^2$, in particular less than 9 $cm^2$. The throughflow-opening 30, in this case, can include a circular or elliptical cross section. However, another cross-sectional form for the throughflow-opening 30, in particular a rectangular cross-sectional form or a cross-sectional form that is similar to a rectangular cross-sectional form, can also be advantageous.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a combustion engine having a cylinder and a crankcase;

a fan wheel defining a rotational axis and configured to convey cooling air for the combustion engine;

a fan wheel housing;

said fan wheel being arranged in said fan wheel housing and configured to be driven rotatingly in a rotational direction by said combustion engine;

said fan wheel housing including a peripheral delimiter and a rear wall which faces said crankcase of said combustion engine;

said peripheral delimiter having a first end and a second end;

said first end and said second end delimiting an outlet for cooling air to be conveyed to said cylinder;

said outlet extending from said second end to said first end in said rotational direction;

said fan wheel housing defining a throughflow-opening through which the cooling air flows out of said fan wheel housing to the outside of said crankcase;

wherein an angular distance (α), measured proceeding from said first end in said rotational direction, between said first end and said throughflow-opening is smaller than an angular distance (ß), measured proceeding from said throughflow-opening in said rotational direction, between said throughflow-opening and said second end; and, wherein said angular distance (α) and said angular distance (ß) are each measured about said rotational axis as a peripheral angle.

2. The work apparatus of claim 1, wherein said angular distance (α), measured proceeding from said first end in said rotational direction, between said first end and said throughflow-opening, is less than 120°.

3. The work apparatus of claim 1, wherein said throughflow-opening extends at least in part into said rear wall of said fan wheel housing.

4. The work apparatus of claim 1, wherein said throughflow-opening extends at least in part into said peripheral delimiter of said fan wheel housing.

5. The work apparatus of claim 1, wherein:

said throughflow-opening has a rearward side; and, an elevation, which projects into the fan wheel housing, is arranged on the rearward side of the throughflow-opening in the rotational direction of said fan wheel.

6. The work apparatus of claim 1, wherein:

said combustion engine includes a muffler;

said muffler is arranged in a muffler space;

said fan wheel housing defines an interior space; and, said throughflow-opening connects said interior space of said fan wheel housing to said muffler space.

7. The work apparatus of claim 6, wherein:

said fan wheel housing has a wall with a section delimiting said interior space of said fan wheel housing with one side and said muffler space with a second side opposite said first side; and, said throughflow-opening is arranged in said section of the wall of said fan wheel housing.

8. The work apparatus of claim 6 further comprising:

an engine housing having an engine housing wall; and, said muffler and said engine housing wall defining an intermediate space formed therebetween into which the cooling air flows from said throughflow-opening.

9. The work apparatus of claim 6 further comprising at least one cooling rib which projects into said muffler space.

10. The work apparatus of claim 9 further comprising:

at least one cylinder foot screw;

said cylinder being fixed on said crankcase via said at least one cylinder foot screw;

said crankcase defining a bore therein and having a wall section adjoining said bore;

said at least one cylinder foot screw projecting into said bore in said crankcase; and, said at least one cooling rib being arranged on the outside of said wall section of said crankcase.

11. The work apparatus of claim 9 further comprising:

an engine housing having an engine housing wall;

said muffler and said engine housing wall defining an intermediate space formed therebetween into which the cooling air flows from said throughflow-opening; and, said at least one cooling rib extending parallel to said engine housing wall.

12. The work apparatus of claim 9, further comprising:
an engine housing having an engine housing wall; and,
said muffler and said engine housing wall defining an intermediate space formed therebetween into which the cooling air flows from said throughflow-opening; and,
said at least one cooling rib being arranged on said engine housing wall.

13. The work apparatus of claim 9, wherein:
said muffler space includes a first transverse side which lies adjacent to said fan wheel housing;
said muffler space further includes a second transverse side arranged opposite said first transverse side; and,
said at least one cooling rib extends up to said first transverse side.

14. The work apparatus of claim 1 further comprising:
at least one cooling rib;
said combustion engine including a muffler;
said muffler being arranged in a muffler space;
said muffler space including a first transverse side which lies adjacent to said fan wheel housing;
said muffler space further including a second transverse side arranged opposite said first transverse side; and,
said at least one cooling rib being arranged on said second transverse side of said muffler space.

15. The work apparatus of claim 1, wherein said peripheral delimiter and said rotational axis define a mutual distance (a, c) between each other which is smaller on said first end than on said second end.

16. The work apparatus of claim 1, wherein:
said peripheral delimiter extends in a helical manner at least in a part section;
said peripheral delimiter and said rotational axis of said fan wheel define a mutual distance (a, b) between each other;
and,
said mutual distance (a, b) increases in said part section in said rotational direction of said fan wheel.

17. A handheld work apparatus comprising:
a combustion engine having a cylinder and a crankcase;
a fan wheel defining a rotational axis and configured to convey cooling air for the combustion engine;
a fan wheel housing;
said fan wheel being arranged in said fan wheel housing and configured to be driven rotatingly in a rotational direction by said combustion engine;
said fan wheel housing including a rear wall which faces said crankcase of said combustion engine and a peripheral delimiter;
said peripheral delimiter having a first end and a second end;
said first end and said second end delimiting an outlet for cooling air to be conveyed to said cylinder;
said outlet extending from said second end to said first end in said rotational direction;
said fan wheel housing defining a throughflow-opening through which the cooling air flows out of said fan wheel housing to the outside of said crankcase;
wherein an angular distance ($\alpha$), measured proceeding from said first end in said rotational direction, between said first end and said throughflow-opening is smaller than an angular distance (ß), measured proceeding from said throughflow-opening in said rotational direction, between said throughflow-opening and said second end;
wherein said angular distance ($\alpha$) and said angular distance (ß) are each measured about said rotational axis as a peripheral angle; and,
said throughflow-opening extending at least in part into said rear wall of said fan wheel housing.

* * * * *